US006169482B1

(12) United States Patent
Altwasser et al.

(10) Patent No.: US 6,169,482 B1
(45) Date of Patent: Jan. 2, 2001

(54) RESONANT CIRCUIT FOR ELECTRONIC ANTI-THEFT ELEMENT

(75) Inventors: Richard Altwasser, Forst (DE); Peter Lendering, Terborg (NL)

(73) Assignee: Meto International GmbH, Hirschhorn (DE)

( * ) Notice: Under 35 U.S.C. 154(b), the term of this patent shall be extended for 0 days.

(21) Appl. No.: 09/147,645

(22) PCT Filed: Jul. 29, 1997

(86) PCT No.: PCT/EP97/04113

§ 371 Date: Feb. 8, 1999

§ 102(e) Date: Feb. 8, 1999

(87) PCT Pub. No.: WO98/06074

PCT Pub. Date: Feb. 12, 1998

(30) Foreign Application Priority Data

Aug. 6, 1996 (DE) ..... 196 31 775
Feb. 14, 1997 (DE) ..... 197 05 722

(51) Int. Cl.[7] ..... G08B 13/24

(52) U.S. Cl. ..... 340/572.3; 340/572.5; 340/572.7

(58) Field of Search ..... 340/572.5, 572.7, 340/572.3

(56) References Cited

U.S. PATENT DOCUMENTS 4,498,076 2/1985 Lichtblau ..... 340/572
4,567,473 * 1/1986 Lichtblau ..... 340/572.3
4,876,555 * 10/1989 Jogensen ..... 340/572.3
5,187,466 * 2/1993 Pichl ..... 340/572.3
5,285,191 * 2/1994 Reeb ..... 340/572.5

FOREIGN PATENT DOCUMENTS

0280361A1 8/1988 (EP) .
0285559A1 10/1988 (EP) .
0472073A2 2/1992 (EP) .
0509289A2 10/1992 (EP) .
0755035A1 1/1997 (EP) .
WO 83/04448 12/1983 (WO) .
WO 92/21113 11/1992 (WO) .

* cited by examiner

*Primary Examiner*—Glen Swann
(74) *Attorney, Agent, or Firm*—Jones, Tullar & Cooper, P.C.

(57) ABSTRACT

A resonant circuit for an anti-theft element consists of two spiral printed circuits and one dielectric layer. The spiral printed circuits are wound in opposing directions and arranged on opposite sides of the dielectric layer so that they at least partly overlap. At least one selected area is provided in which a conductive path arises between the two spiral printed circuits whenever a sufficiently high energy is applied by means of an external alternating field.

10 Claims, 2 Drawing Sheets

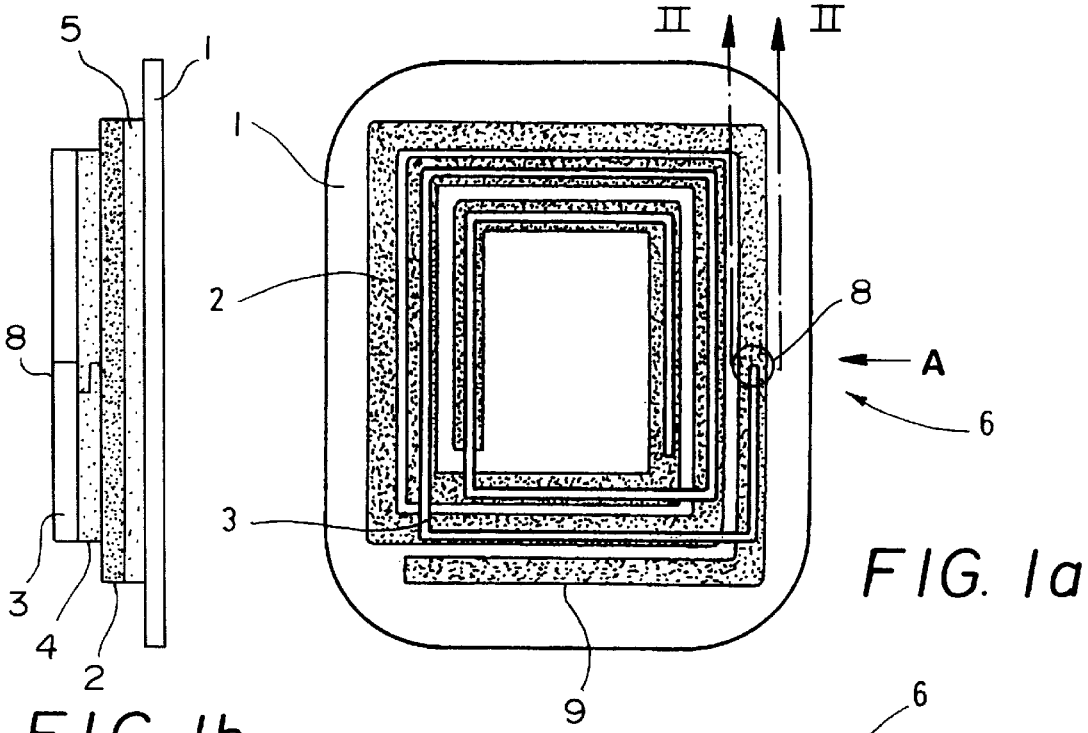
FIG. 1a
FIG. 1b
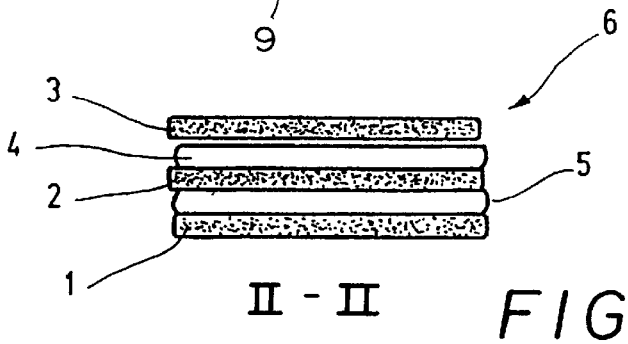
FIG. 2
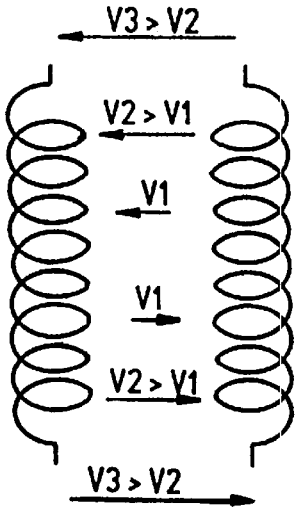
FIG. 3

RESONANT CIRCUIT FOR ELECTRONIC ANTI-THEFT ELEMENT

CROSS REFERENCE TO RELATED APPLICATION

This application discloses subject matter in common with co-pending application, Ser. No. 09/147,646, filed Feb. 8, 1999.

FIELD OF THE INVENTION

The present invention relates to a resonant circuit for electronic article surveillance.

BACKGROUND OF THE INVENTION

Resonant circuits which are excited to resonate at a predetermined resonant frequency which is conventionally at 8.2 MHz are widely accepted as anti-pilferage devices in department stores. Frequently the circuits are an integral part of adhesive labels or cardboard tags which are affixed to the articles to be maintained under surveillance. Typically, the department store has an electronic surveillance system installed in the exit area, which detects the resonant circuits and produces an alarm when a protected article passes through a surveillance zone in an unauthorized manner. The resonant circuit is deactivated when a customer has paid the merchandise. This prevents an alarm being produced once an article has been rightly acquired by purchase, passing through the surveillance zone subsequently.

The deactivation systems which are frequently installed in the checkout area generate a resonant signal of a higher amplitude than it is produced in the surveillance systems. A resonant label is normally deactivated with a signal whose field strength is greater than 1.5 Ampere turns per meter.

A variety of deactivating mechanisms for resonant circuits are known in the art. They involve either destroying the insulation between two opposing conductive tracks, producing a short circuit, or subjecting a length of conductive track to overload and causing it to melt, thereby interrupting the circuit path. As a consequence of deactivation, the resonant properties of the resonant circuit, that is, the resonant frequency and/or the "Q" factor are modified so severely that the resonant label stops being detected by the surveillance system.

With regard to the deactivation of resonant labels, different methods have been described in the art. In U.S. Pat. No. 4,876,555 and its corresponding European Patent, EP 0 285 559 B1, it is proposed to use a needle to produce a hole in the insulating layer between two opposite capacitor surfaces. This results in a fault-free and permanent deactivation mechanism.

U.S. Pat. No. 5,187,466 describes likewise a method for generating a deactivatable resonant circuit by means of a short circuit.

As regards the first mentioned U.S. Pat. No. 4,876,555 and its corresponding European Patent EP 0 285 559 B1, it should be noted that the resonant circuit therein disclosed includes capacitor plates which are disposed on either side of a dielectric material. The dielectric layer arranged between the two capacitor plates has a through hole.

In U.S. Pat. No. 5,187,466 referred to in the foregoing, a method is described which is applied to a resonant circuit having capacitor plates on either side of a dielectric, and in which the capacitor plates are first short-circuited and the short circuit is melted later by the application of electrical energy.

European Patent EP 0 181 327 B1, describes a deactivatable resonant label which is composed of a dielectric substrate layer, capacitor plates on either side of the dielectric layer, and a coiled winding on one of the two sides of the dielectric layer. To ensure reliable deactivation of the resonant label, a selected area is treated for deactivation. In particular, in this area the dielectric layer is thinner than in the remaining areas.

SUMMARY OF THE INVENTION

It is an object of the present invention to provide a resonant circuit which can be deactivated reliably.

This object is accomplished in that the resonant circuit is comprised of two coiled conductive tracks and one dielectric layer, said two conductive tracks being wound in opposite directions and disposed on either side of the dielectric layer such as to overlap at least in part, with at least one selected area being provided in which a conductive path is produced between the two tracks as soon as energy in a sufficiently high amount is applied by an external alternating field. Thus the present invention has no separate capacitor plates; rather, these are formed directly by the two at least partly overlapping tracks.

According to an advantageous further aspect of the resonant circuit of the present invention, the dielectric layer is of substantially uniform thickness and has no additional manufacturing defects (air inclusions, for example).

This configuration is particularly advantageous in combination with a yet further aspect according to which the selected area is at the outer end areas of the tracks where the tracks' induced voltage is at its highest level. Any special treatment of any point on the resonant circuit is thus entirely superfluous with this configuration. Utilizing the laws of physics, the deactivation area is automatically in a predeterminable area at the outer ends of the coiled tracks.

In an alternative configuration of the resonant circuit of the present invention it is proposed that the selected area be at any desired point on the overlapping tracks and be treated such that the conductive path is built up at the point thus treated when the deactivation signal is applied.

In this connection particularly, provision is made for the dielectric layer to be thinner in the selected area than it is in the remaining areas, or for the treated point to be a hole in the dielectric layer. In a further configuration of the resonant circuit of the present invention, provision is made for the dielectric layer to have a different physical or chemical property in the selected area.

In an advantageous further aspect of the resonant circuit of the present invention, the dielectric layer is comprised of at least two components. This enables dielectric layers to be produced which are highly homogeneous and contain air inclusions in negligible amounts only. In this configuration, therefore, it has proven to be advantageous for the melting point of the one component to lie above the production temperature for the resonant circuits, that is, this layer will not melt during the manufacturing process. According to a further aspect of the resonant circuit, the components are furthermore of a nature enabling them to be joined together by either a coating or a laminating process.

Reference has been made in the foregoing to the advantageous embodiment of the resonant circuit of the present invention in which the deactivation area occurs in the overlapping outer end areas of the coiled tracks on account of physical conditions. To enhance this effect still further, in an advantageous further aspect of the resonant circuit of the present invention, the areas of overlap between the two tracks, and hence the capacitance between the coiled tracks, are concentrated at the inner ends of the tracks.

It is therefore a further object of the present invention to provide a dielectric layer which is substantially uniform in thickness and largely free from local weak points occurring in production. Such a uniform dielectric layer 4 ensures deactivation at those points where voltage and energy are at their highest levels, that is, related to the example shown at the ends of the upper track 3. Short circuits produced by such deactivation are very robust with little susceptibility to accidental reactivation.

Furthermore, reliability of deactivation can be improved still further by arranging for the outer ends of the two tracks to overlap in a small area and by having a relatively long length of track with no overlap adjacent to the outer ends of the tracks.

The present invention will be explained in more detail in the following with reference to the accompanying drawings.

BRIEF DESCRIPTION OF THE DRAWINGS

FIG. 1*a* is a plan view of an embodiment of the resonant circuit of the present invention;

FIG. 1*b* is a side view taken in the direction of arrow A of FIG. 1*a*.

FIG. 2 is a cross sectional view of the resonant circuit of FIG. 1 taken along the line II—II of FIG. 1*a*.

FIG. 3 is a schematic illustration of the voltages with two partly overlapping coiled tracks;

DESCRIPTION OF THE PREFERRED EMBODIMENTS

Figure 4:
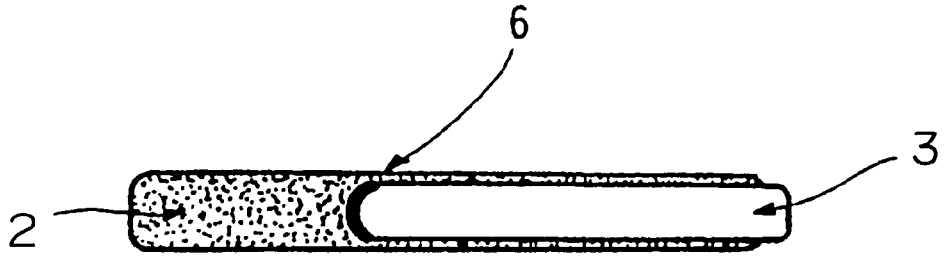
FIG. 4 is a plan view of the outer end area of the coiled tracks.

FIGS. 1*a* and 1*b* show an embodiment of the resonant circuit 6 of the present invention on a substrate material 1 in plan view, and in a side view, respectively. FIG. 2 shows the resonant circuit 6 of FIG. 1 in cross sectional view.

Deactivation of the resonant circuit 6 takes place by producing a short circuit between the two coiled conductive tracks 2, 3, through the dielectric layer 4. The two coiled conductive tracks are preferably fabricated from aluminum. The application of an alternating magnetic field as emitted, for example, by the surveillance system induces alternating voltages in the two coiled tracks 2, 3 of the resonant circuit 6. The two coiled tracks 2, 3 which overlap at least in part are wound in opposite directions. Therefore, the outer end of the lower coil 2 has a positive potential with respect to the inner end of the lower coil 2 when the inner end of the upper coil 3 has a positive potential with respect to the outer end of the upper coil 3. It will be understood, therefore, that the points/areas in which the induced alternating voltages between the two coils 2, 3 are at their highest levels are located in the end areas of the coils 2, 3. The point of overlap is adjacent a relatively long length of track (9 in FIG. 1*a*) having no overlap.

Considering that in the example illustrated in FIG. 1 the upper coil 3 has fewer turns than the lower coil 2, the highest voltages are generated between the ends of the upper coil 3 and the areas of the lower coil 2 situated directly underneath. FIG. 3 illustrates clearly the voltage relationships in different areas of the two at least partly overlapping coils 2, 3 of a resonant circuit 6 that is suitable for use according to an advantageous further aspect of the resonant circuit 6 of the present invention.

FIG. 3 illustrates the individual voltages occurring in different areas of the two overlapping coils 2, 3 along their length during electromagnetic induction.

In the resonant circuit 6 previously described in which the dielectric layer 4 between the coils 2, 3 is of uniform thickness, deactivation takes place in the end areas of the upper coil 3 and the lower coil 2, because this is where the induced potential is at its highest level. Because the electric field strength is focused on a surface with a small radius, deactivation takes place precisely at the ends of the tracks 2, 3, as shown in FIG. 4. The dielectric layer 4 may be thinner at this point (as seen at 8 in FIG. 1*b*) to enhance deactivation.

If however the dielectric layer 4 is not of uniform density or contains air inclusions 7, which may happen easily as a result of manufacturing defects, deactivation may take place in various areas of the coils 2, 3. Such manufacturing defects may cause local weaknesses and even produce holes resulting from air inclusions in the dielectric layer 4. As a consequence, the dielectric layer 4 breaks down at these local weak points although the voltage potential is lower at these points than it is at the ends of the upper and lower track 3, 2. Because the voltage potential is lower at the local weak points than it is at the ends of the tracks 2, 3, the electrical energy available for producing the deactivation short circuit is smaller than the electrical energy that would be necessary to produce a deactivation short circuit at the ends of the upper coil 3.

Figure 5:
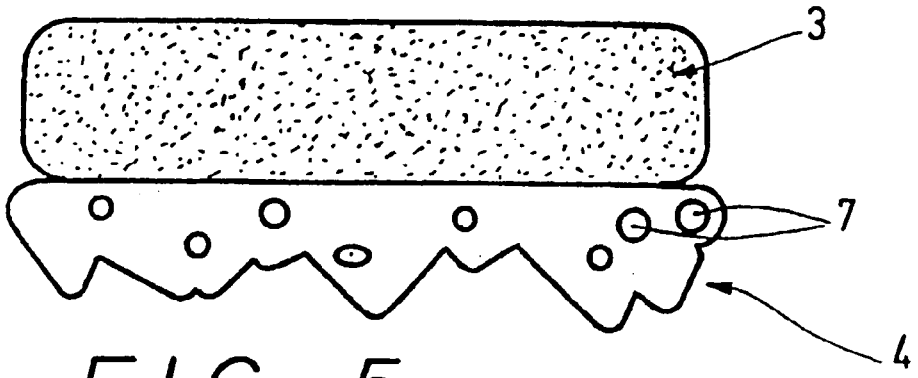
FIG. 5 is an enlarged cross sectional view of the upper coil and the upper component of the dielectric layer.

FIG. 5 shows a cross section of a dielectric layer 4 exhibiting manufacturing defects in the form of air inclusions 7 and irregularities in the surface area.

According to an advantageous further aspect of the resonant circuit 6 of the present invention, the dielectric layer 4 is comprised of at least two components 4*a*, 4*b*, including an upper component 4*a* and a lower component 4*b*. The lower component 4*b* is applied to the lower coil 2 prior to stamping and hot embossing. The upper component 4*a* is applied to the upper coil 3. The upper component 4*a* has a relatively low melting point enabling it to serve as a hot-melt-type adhesive and to adhesively bond the two coils 2, 3 together during hot embossing of the upper coil 3 onto the lower coil 2. The upper component 4*a* of the dielectric layer 4 melts during hot embossing of the upper coil 3. Having a higher melting point, the lower component 4*b* of the dielectric layer 4 does not melt during hot embossing on the upper coil 3. The uniformity of the lower component 4*b* of the dielectric layer 4 which does not melt improves overall the uniformity of thickness of the dielectric layer 4.

Figure 6:
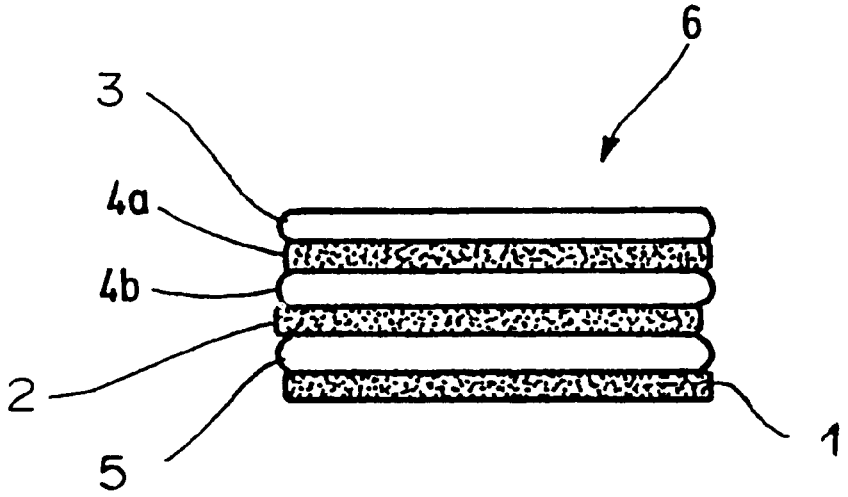
FIG. 6 is a detailed cross-sectional view of the resonant circuit of the present invention.

FIG. 6 shows a cross section of a resonant circuit 6 having a dielectric layer 4 composed of two components 4*a*, 4*b*. The lower component 4*b* may be produced either by coating the lower coil 2 or by laminating the lower component 4*b* of the dielectric layer 4 onto the coil 2. Typically the coil material (aluminum) is available in the form of broad coils enabling uniformity of the surface of the dielectric layer 4 to be maintained and other defects caused, for example, by air inclusions 7, to be minimized.

What is claimed is:

1. A resonant circuit for electric article surveillance, comprising: two coiled conductive tracks and one dielectric layer, wherein said two coiled conductive tracks are wound in opposite directions and are disposed on respective opposite sides of the dielectric layer, such as to overlap at least in part, wherein at least one selected area is provided in which a conductive path is produced between the two coiled conductive tracks as soon as energy in a sufficiently high amount is applied by an external alternating field, and wherein the dielectric layer is of substantially uniform density.

2. The resonant circuit as claimed in claim 1, wherein the dielectric layer is comprised of at least two components.

3. The resonant circuit as claimed in claim 2, wherein the melting point of one of the components lies above the production temperature for the resonant circuits.

4. The resonant circuit as claimed in claim 2, wherein the components are of a nature enabling them to be joined together by either a coating or a laminating process.

5. The resonant circuit as claimed in claim 1, wherein the areas of overlap between the two coiled conductive tracks and hence the capacitance between the coiled conductive tracks are concentrated at the inner ends of the coiled tracks.

6. The resonant circuit as claimed in claim 5, wherein the outer ends of the two coiled conductive tracks overlap in a small area and a relatively long length of track with no overlap is adjacent to the outer ends of the coiled conductive tracks.

7. The resonant circuit as claimed in claim 1, wherein the selected area is characterized in that the dielectric layer has a hole.

8. A resonant circuit for electronic article surveillance, comprising: two coiled conductive tracks and one dielectric layer, wherein said two coiled conductive tracks are wound in opposite directions and are disposed on respective opposite sides of the dielectric layer, such as to overlap at least in part, wherein at least one selected area is provided at the outer end area of one of said two coiled conductive tracks and the overlapping areas of the said two coiled conductive tracks are situated directly underneath where the induced voltage of said one of said two coiled conductive tracks is at its highest level, and wherein a conductive path is produced in the selected area between said two coiled conductive tracks as soon as energy in a sufficiently high amount is applied by an external alternating field.

9. A resonant circuit for electronic article surveillance, comprising: two coiled conductive tracks and one dielectric layer, wherein said two coiled conductive tracks are wound in opposite directions and are disposed on respective opposite sides of the dielectric layer, such as to overlap at least in part, wherein at least one selected area is provided in which a conductive path is produced between the two coiled conductive tracks as soon as energy in a sufficiently high amount is applied by an external alternating field, the selected area is treated such that the conductive path is built up in the selected area when the deactivation signal is applied, and wherein the dielectric layer is thinner in the selected area than it is in the remaining areas.

10. A resonant circuit for electronic article surveillance, comprising: two coiled conductive tracks and one dielectric layer, wherein said two coiled conductive tracks are wound in opposite directions and are disposed on respective opposite sides of the dielectric layer, such as to overlap at least in part, wherein at least one selected area is provided in which a conductive path is produced between said two coiled conductive tracks as soon as energy in a sufficiently high amount is applied by an external alternating field, the selected area is treated such that the conductive path is built up in the selected area when the deactivation signal is applied, and wherein the dielectric layer has a different physical or chemical property in the selected area.

* * * * *